US010472929B2

(12) United States Patent
Miller et al.

(10) Patent No.: US 10,472,929 B2
(45) Date of Patent: Nov. 12, 2019

(54) TUBULAR ISOLATION VALVE RESETTABLE LOCK OPEN MECHANISM

(71) Applicant: BAKER HUGHES, A GE COMPANY, LLC, Houston, TX (US)

(72) Inventors: Wade A. Miller, Broken Arrow, OK (US); John E. Burris, Bixby, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 362 days.

(21) Appl. No.: 15/415,327

(22) Filed: Jan. 25, 2017

(65) Prior Publication Data

US 2018/0209246 A1 Jul. 26, 2018

(51) Int. Cl.

| | |
|---|---|
| ***E21B 34/14*** | (2006.01) |
| ***E21B 34/10*** | (2006.01) |
| ***E21B 23/00*** | (2006.01) |
| *E21B 34/00* | (2006.01) |

(52) U.S. Cl.

CPC ..... *E21B 34/14* (2013.01); *E21B 23/006* (2013.01); *E21B 34/10* (2013.01); *E21B 2034/005* (2013.01)

(58) Field of Classification Search

CPC ..... E21B 34/08

See application file for complete search history.

(56) References Cited

U.S. PATENT DOCUMENTS

| | | | | |
|---|---|---|---|---|
| 4,446,922 | A | 5/1984 | Bowyer et al. | |
| 5,167,284 | A | 12/1992 | Leismer | |
| 5,598,864 | A | 2/1997 | Johnston et al. | |
| 6,684,958 | B2 | 2/2004 | Williams et al. | |
| 7,137,452 | B2 | 11/2006 | McVicker | |
| 7,363,980 | B2 * | 4/2008 | Pringle | E21B 23/006 166/319 |
| 7,527,104 | B2 | 5/2009 | Branch et al. | |
| 7,703,541 | B2 | 4/2010 | Parks et al. | |
| 7,717,185 | B2 | 5/2010 | Anderson et al. | |
| 7,779,919 | B2 | 8/2010 | Goughnour et al. | |
| 8,607,811 | B2 | 12/2013 | Korkmaz | |
| 9,394,762 | B2 | 7/2016 | McDowell et al. | |
| 9,422,790 | B2 | 8/2016 | Williamson et al. | |
| 2007/0137869 | A1 | 6/2007 | MacDougall et al. | |

* cited by examiner

*Primary Examiner* — D. Andrews

(74) *Attorney, Agent, or Firm* — Shawn Hunter

(57) ABSTRACT

A safety valve features a flow tube operated flapper for the normal open and closed positions that can be obtained with one or two control lines to a principal operating piston. Pressure applied to the piston moves the flow tube to rotate the flapper open behind the flow tube. Release of pressure to the principal piston allows a closure spring to return the flow tube up to let the flapper close. A secondary piston can drive the flow tube with applied pressure through a control line. Cycling the applied pressure in combination with an indexing mechanism allows the flapper to be locked open and then released to normal operation. The pistons act as backup for each other as they both drive the flow tube. The flow tube has a clearance fit to the body in the locked open position to exclude debris from the flapper.

18 Claims, 7 Drawing Sheets

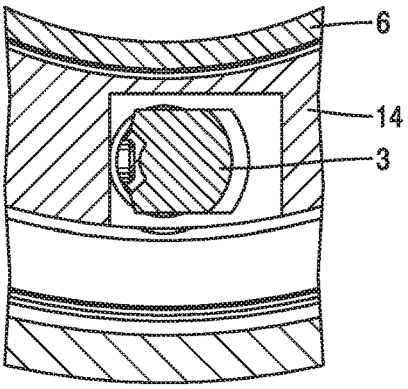
FIG. 6a
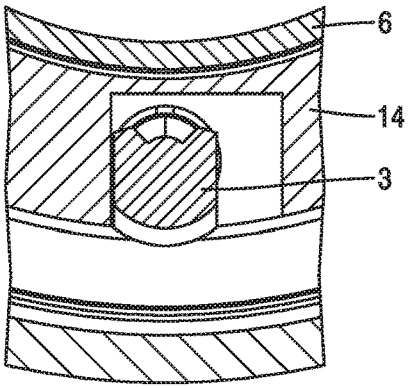
FIG. 6b
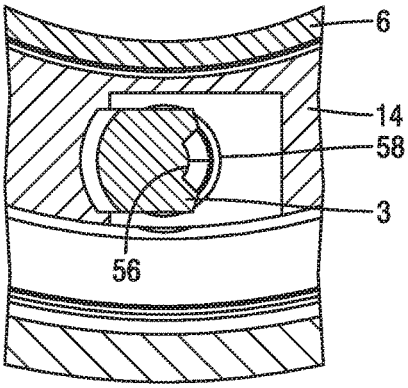
FIG. 6c
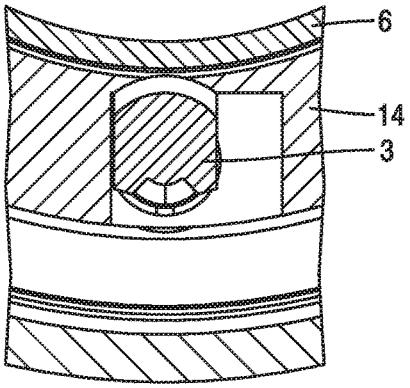
FIG. 6d
FIG. 6e
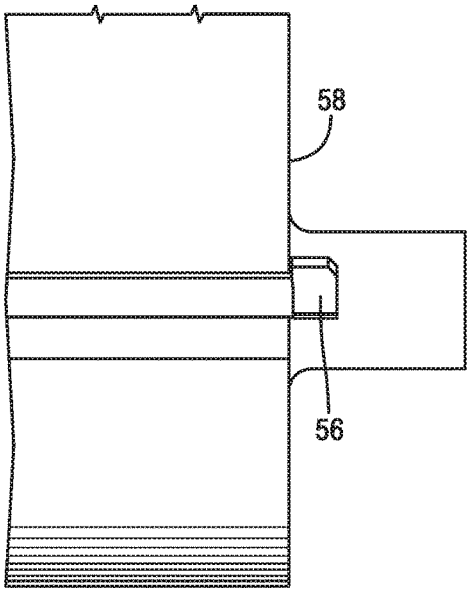

TUBULAR ISOLATION VALVE RESETTABLE LOCK OPEN MECHANISM

FIELD OF THE INVENTION

The field of the invention is a tubular string isolation valve and more particularly a flow tube actuated flapper or other type of closure such as a ball (hereinafter collectively called "flapper") type safety valve that allows the flow tube to be releasably locked to the housing when the flapper is open and released for return to normal operation.

BACKGROUND OF THE INVENTION

Safety valves in tubular strings such as a production string in a borehole or a production riser from a subsea wellhead at times need to be held open. Early designs managed to lock the valve open in such a way that further functionality of the valve was destroyed. One example is U.S. Pat. Nos. 7,137,452; 7,703,541 and U.S. Pat. No. 5,598,864. Other designs used a flow through method to open the flapper and combined flow through the passage in cycles of pressure actuation and removal with a j-slot mechanism to hold a flapper open and another cycle to release the flapper for normal operation. These designs left the flapper open to the flow path where accumulated debris could impede the movement of the hold down mechanism or the flapper. Some examples of this are U.S. Pat. Nos. 7,527,104 and 8,607,811. Some devices would disable the safety valve and obtain access to the hydraulic system to run other tools. An intervention into the string was required to do this. In some applications like marine risers there is a 90 degree bend in the riser near the platform preventing inserting tools to lock open the valve while also disabling its hydraulic system from resuming normal operation. One example is U.S. Pat. No. 7,717,185. Another design involved delivering and expanding a sleeve to hold the flapper open and disable the safety valve from further normal operation and is shown in U.S. Pat. No. 6,684,958. U.S. Pat. No. 7,779,919 shows the use of a primary piston to manipulate a flow tube during normal operation and a second hydraulic piston not operably connected to the flow tube that could retain the flapper open. When hydraulic pressure was removed a spring bias allowed release of the flapper to resume normal operation with the flow tube. This design left the flapper exposed to debris in well fluid when locked open. In another design the back of the flapper could selectively engage a hook latch in the open position after being pushed down by the flow tube. A cable release could either prevent the flapper from latching when shifted to open or allow retaining the flapper with a hook entering a recess in the back of the flapper until the flow tube was raised clear of the flapper. A cable could then remove the hook from the back of the flapper allowing it to swing closed for normal operation when the flow tube was then raised up. This design is shown in US 2007/0137869 and it does not appear to be intended to function as a lock open device but rather in high flow situations to avoid flapper or flow tube damage from high flow closing the flapper against a flow tube that is not retracted fast enough by a closure spring.

U.S. Pat. No. 9,422,790 illustrates a flow tube operated flapper where a ratchet can hold the flow tube in the extended position so that the valve is locked open. A tool can then be inserted into the flow tube to latch into the flow tube.

U.S. Pat. No. 9,394,762 shows a debris barrier movable against a flow tube to keep well fluid debris away from the flapper in the open position when the flapper is behind the flow tube.

Probably the most relevant reference with regard to the present invention is U.S. Pat. No. 5,167,284 which shows a main piston associated with a flow tube for normal operation of the flapper for the open and closed positions. A secondary piston moves a one way ratchet through a selectively releasable retainer. The ratchet assembly holds the flow tube in the down position effectively locking the valve open. Release occurs by applying the pressure on the main piston and relieving pressure on the secondary piston which allows a plate 80 to be pushed down to spread the outer ratchet. Bleeding pressure off of the primary and secondary pistons allows the locking secondary piston to full retract so that the flow tube can move up and normal operation of the safety valve can resume. This complex design has a ratchet exposed to well fluids that can get stuck and fail to release the locking piston from trying to push plate 80 down with the primary piston. If the ratchet fails to sufficiently retract the valve stays locked open. The secondary piston cannot operate the valve at all and further features an array of small parts and springs calling into question its reliability in severe environments.

What is needed and provided by the present invention is a flow tube operated flapper that has redundant capability for moving the flow tube when using a primary or a secondary piston. The secondary piston is linked with an indexing feature to respond to pressure cycles to selectively lock the flow tube in the flapper open position or with another pressure cycle on the secondary piston to release the flow tube for normal operation with the primary piston. The flapper can be held open with pressure on the secondary piston in a configuration that if the control pressure on the secondary piston is lost the closure spring will shift the flow tube for a fail-safe configuration of the flapper to the closed position. The flow tube in the locked open position can be a clearance fit to the surrounding housing to minimize debris infiltration to the volume where the open flapper resides behind the flow tube. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A safety valve features a flow tube operated flapper for the normal open and closed positions that can be obtained with one or two control lines to a principal operating piston. Pressure applied to the piston moves the flow tube to rotate the flapper open behind the flow tube. Release of pressure to the principal piston allows a closure spring to return the flow tube up to let the flapper close. A secondary piston can drive the flow tube with applied pressure through a control line. Cycling the applied pressure in combination with an indexing mechanism allows the flapper to be locked open and then released to normal operation. The pistons act as backup for each other as they both drive the flow tube. The flow tube has a clearance fit to the body in the locked open position to exclude debris from the flapper.

BRIEF DESCRIPTION OF THE DRAWINGS

FIGS. 6*a*-6*d* show the secondary piston rotating through two pressure cycles to lock open and then release from the lock open position;

FIG. 6*e* shows the extending boss at the lower end of the secondary piston that engages a housing shoulder as shown in FIGS. 4 and 6*c;*

DETAILED DESCRIPTION OF THE PREFERRED EMBODIMENT

Figure 1:
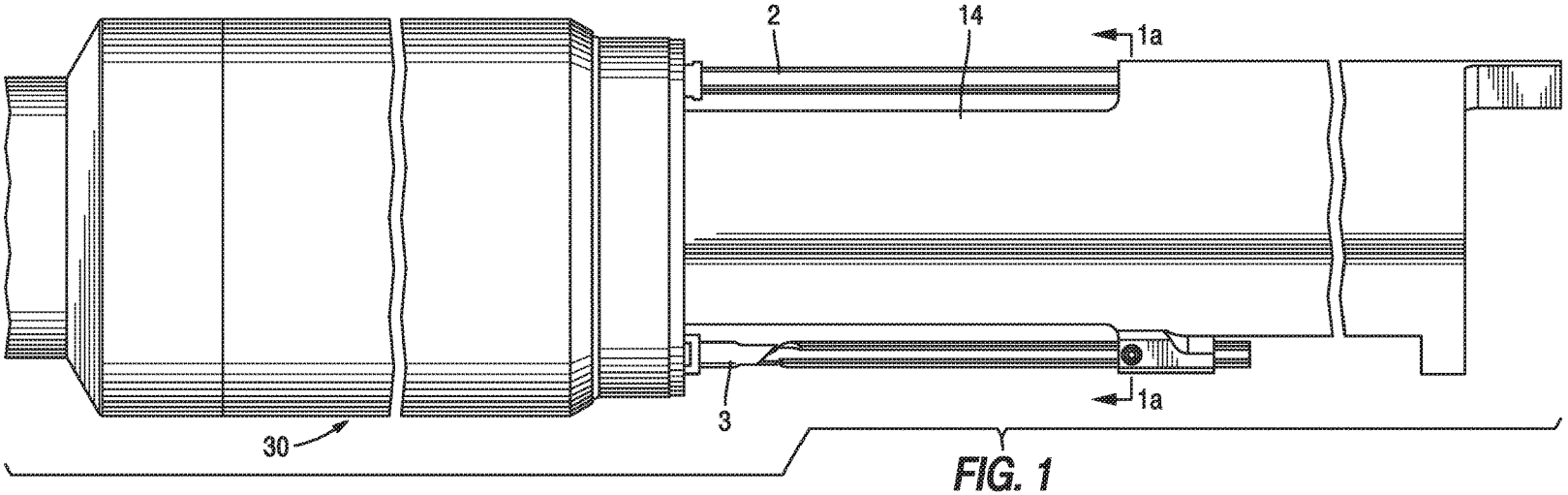
FIG. 1 shows a primary and secondary piston layout with an outer cover removed.
Figure 2:
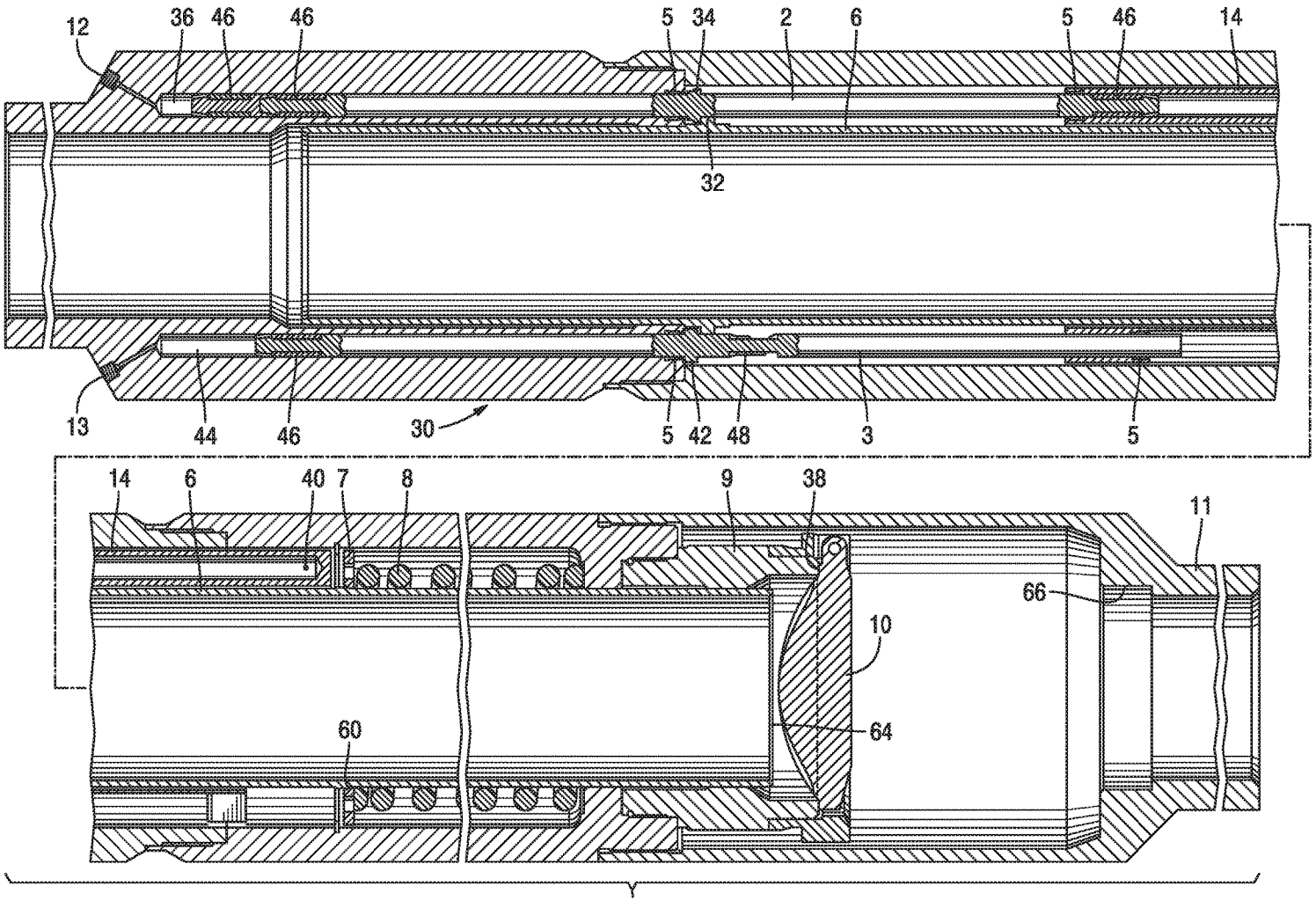
FIG. 2 is a section view of the safety valve in the closed position.

Referring to FIG. 1 a primary piston 2 and a secondary piston 3 are shown preferably spaced 180 degrees apart on housing 30. The names primary and secondary are used to distinguish the two pistons only as will be apparent from the explanation below where the pistons can be redundant allowing either one to operate the flow tube 6. The basic components of the safety valve are a flapper 10 that is rotated 90 degrees by the flow tube 6. Flow tube 6 has a ring or discrete shoulders 32 as shown in FIG. 2. Primary piston 2 has an external ring 34 that engages ring 32 to move the flow tube 6 against the flapper 10. What drives piston 2 is control line pressure to primary piston connection 12 that is retained by piston seals 46 as chamber 36 enlarges in volume as piston 2 is pushed to the right or toward the flapper 10 which is rotated by the linear movement of flow tube 6 caused by ring 34 pushing ring 32. If the pressure in chamber 36 is relieved the closure spring 8 pushes up on ring 7 that is shouldered on abutment 60 on the exterior of the flow tube 6 thus returning the flow tube 6 and the piston 2 to the FIG. 2 position that allows the flapper 10 to rotate 90 degrees to the seat 38. Bushings 5 are spaced apart to guide the movement of piston 2 within cylinder 14 and housing 30 as aligned axially with one another. Connection 40 is on the opposite side of piston 2 from connection 12 an is connected to another control line that is not shown so that the hydrostatic pressure in the control lines going to connections 12 and 40 is balanced and spring 8 does not need to overcome control line hydrostatic pressure. Such a balance line operating system is shown in U.S. Pat. No. 6,173,785 B1. Alternatively a single control line system can be used and in that case the spring 8 needs to be sized to overcome the hydrostatic pressure in chamber 36.

Figure 1B:
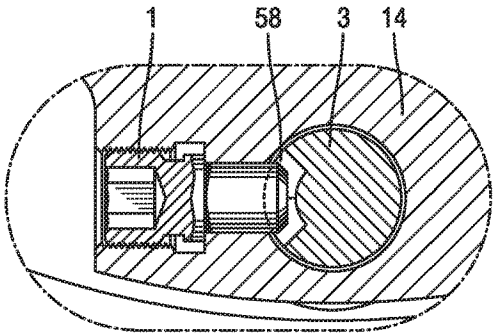
FIG. 1*b* is an enlarged view of a part of FIG. 1*a;*
Figure 1A:
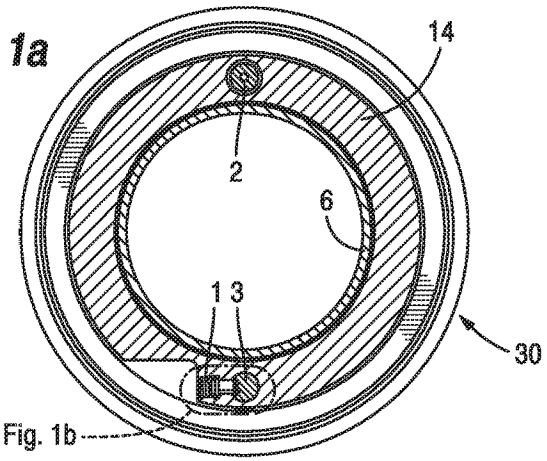
FIG. 1*a* is a section view along line A-A of FIG. 1.
Figure 3:
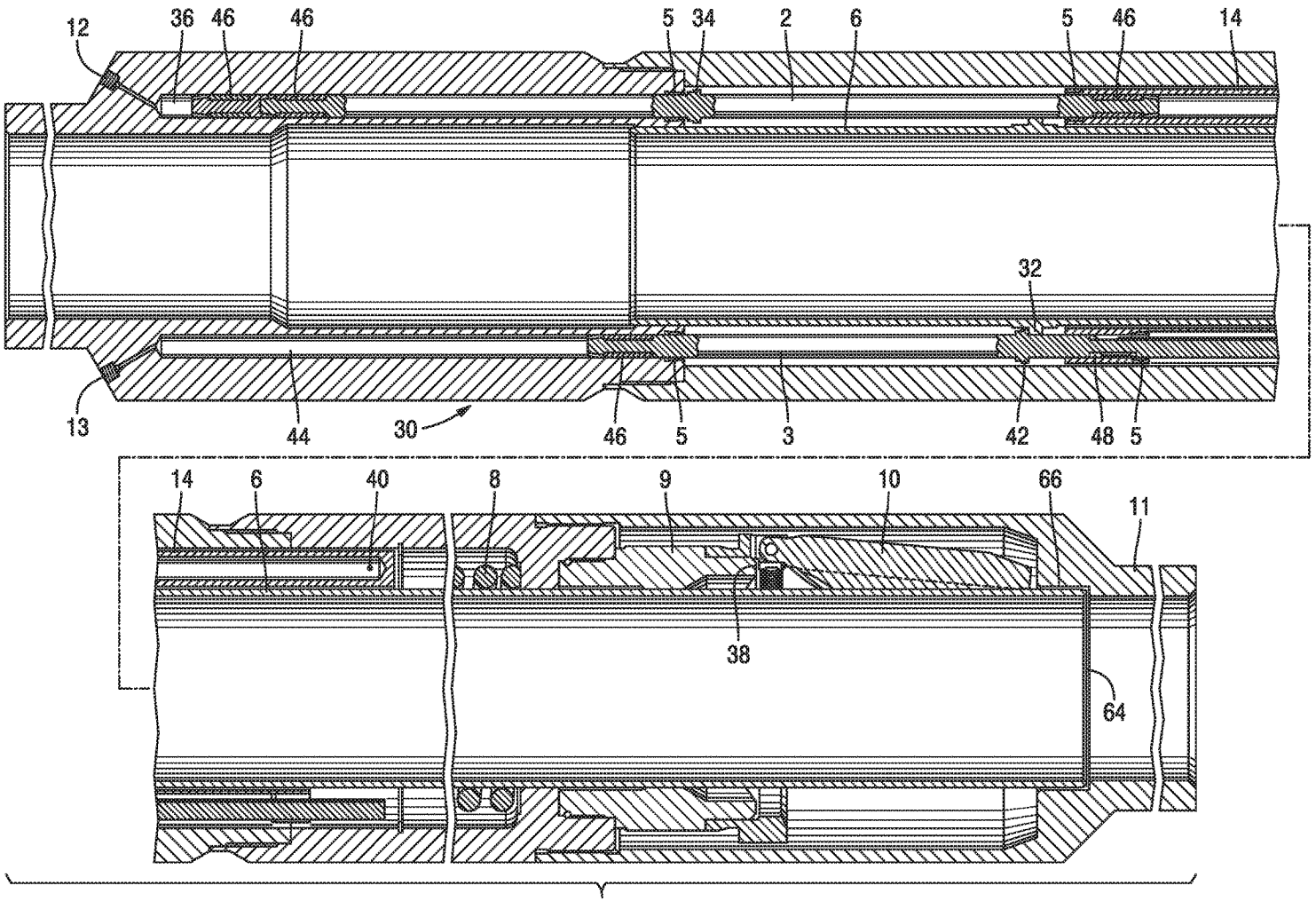
FIG. 3 is the view of FIG. 2 with the valve energized open using the secondary piston.
Figure 4:
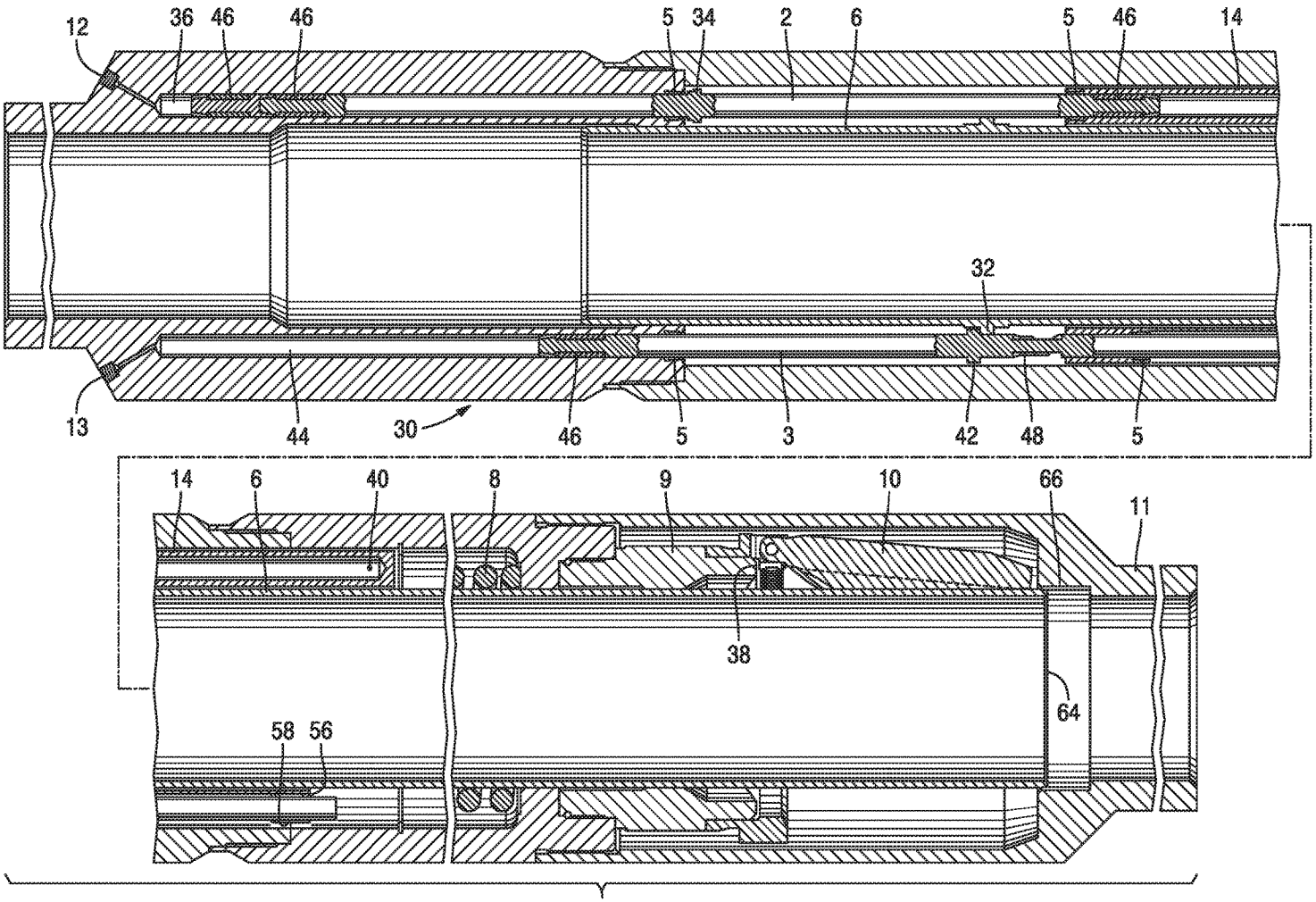
FIG. 4 is the view of FIG. 2 with pressure removed from the secondary piston and the lock open position achieved.
Figure 5:
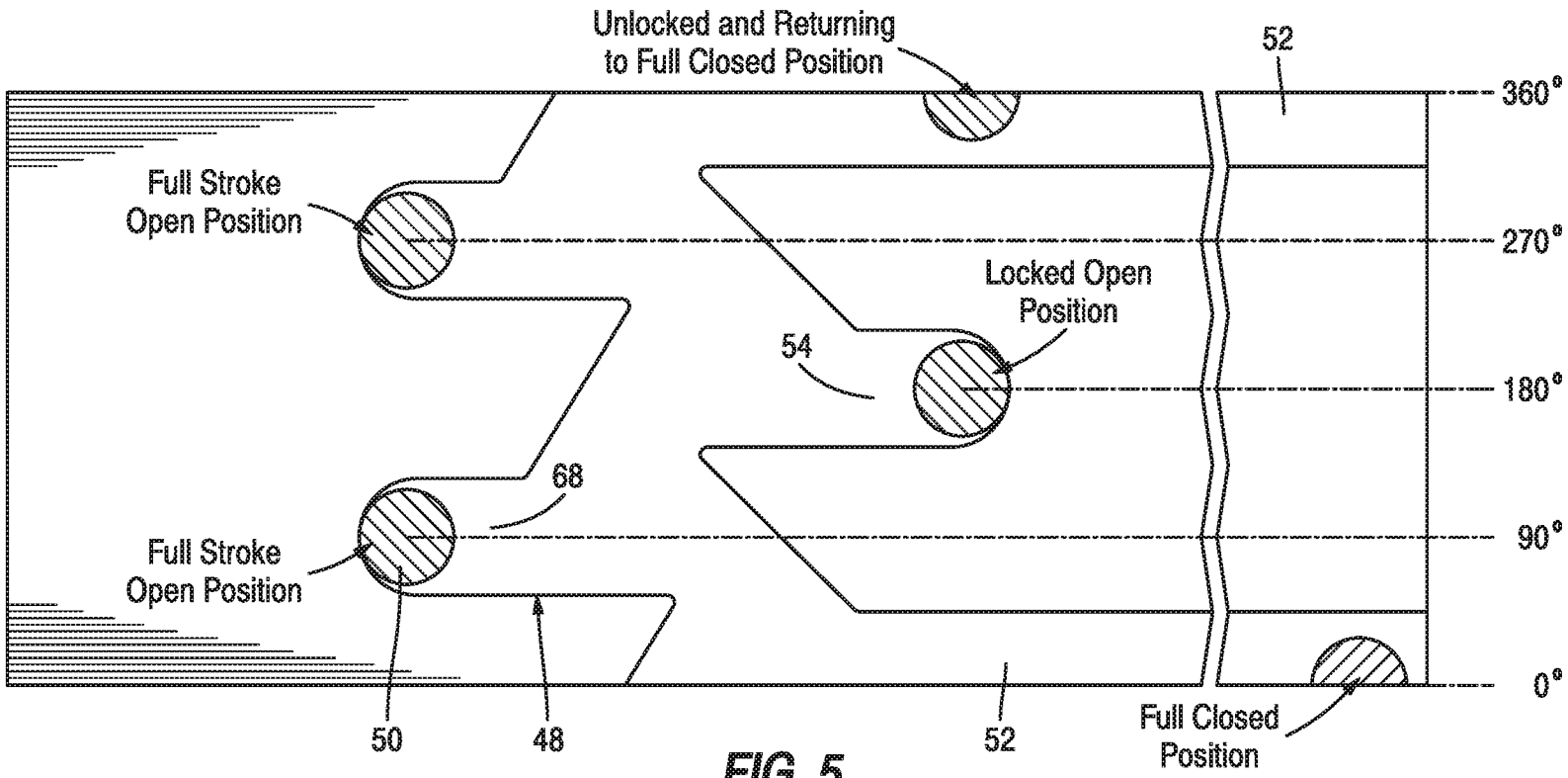
FIG. 5 is a rolled flat presentation of the indexing feature that interacts with the secondary piston.

A secondary piston 3 has an external ring 42 that engages ring 32. Pressure at piston connection 13 against seal 46 enlarges the volume of chamber 44 and removal of such pressure at connection 13 allows piston 3 to be pushed in the opposite direction with spring 8 pushing on flow tube 6. Piston 3 has an exterior j-slot profile 48 that engages a housing pin 50 (also shown as item 1 in FIG. 1*b*) that collectively comprise the indexing assembly so that axial movement of piston 3 can also create rotational movement of piston 3. FIG. 5 shows the profile 48 laid flat and the pin 50. Long slots 52 straddle short slots 54 in a preferably 360 degree pattern. FIG. 6*e* schematically shows an offset lug 56 that can selectively engage a surface 58 to prevent the piston 3 and the flow tube 6 from coming up when pressure is relieved at connection 13. This is one optional way a travel stop can be engaged to limit the movement of the flow tube 6. The indexing pattern 48 rotates the piston 3 90 degrees with each application of pressure and another 90 degrees with each removal of pressure with the illustrated pattern 48. Different patterns can be used to require more than two cycles of pressure application and removal for a full 360 degree rotation without departing from the spirit of the invention. The offset lug 56 is designed to engage the surface 58 after a single cycle depicted in FIGS. 3 and 4. In FIG. 3 pressure applied at connection 13 enlarges chamber 44 and uses external ring 42 to push down on ring 32 to rotate the flapper 10 90 degrees. Relieving the pressure at connection 13 allows lug 56 to engage surface 58 as shown in FIGS. 4 and 6*c*. In this position the flow tube 6 is retained with the flapper 10 open for the selectively locked open position. Another pressure cycle on connection 13 regains the alignment of pin 50, as shown in FIG. 5, with a long slot 52 to allow the flow tube 6 to come back up under the force of spring 8 so that the flapper 10 can close and the FIG. 2 position resumed. Piston 3 is guided by spaced bushings 62.

Figure 7A:
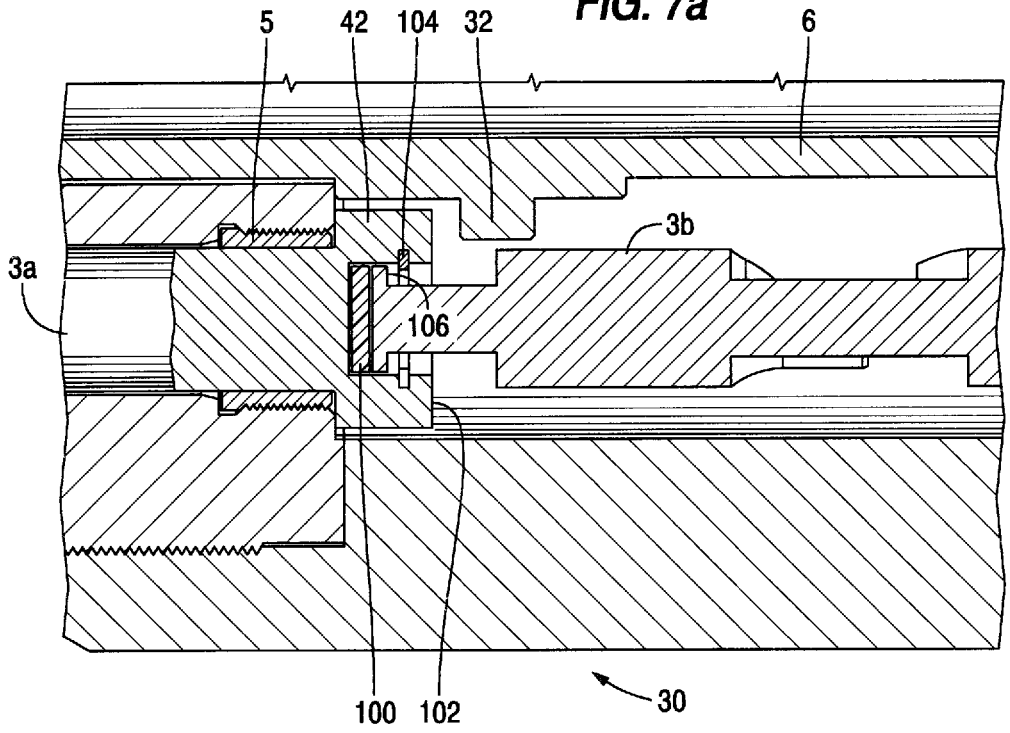
FIG. 7*a* is a section view of a split piston where the lower portion rotates and the upper portion with a bushing does not rotate.
Figure 7B:
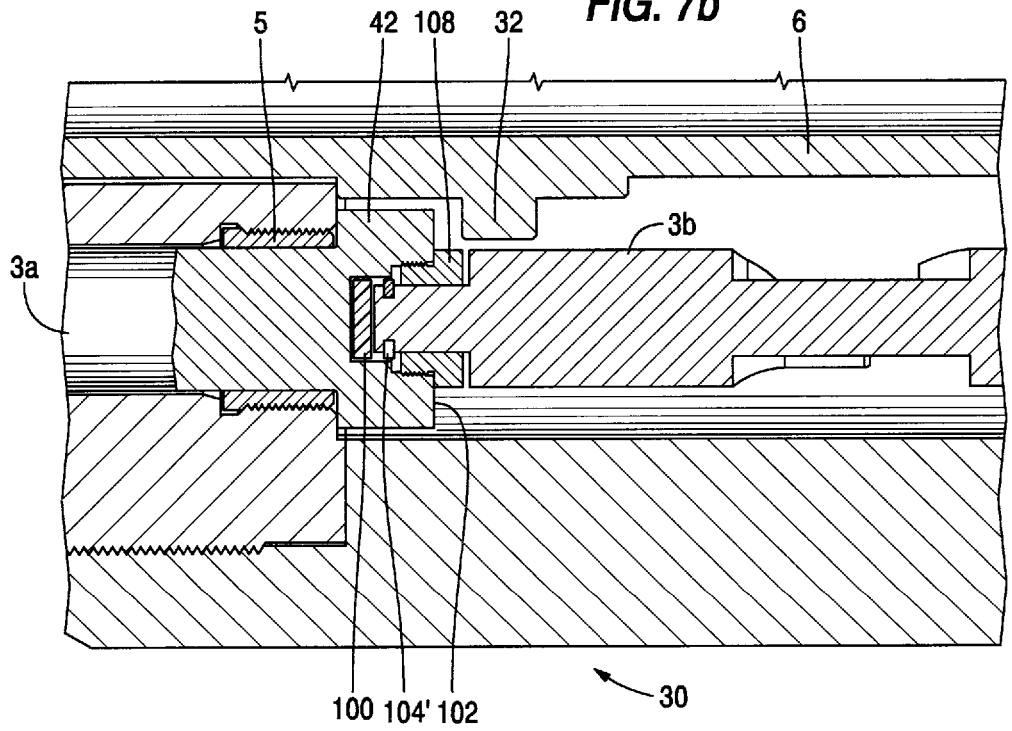
FIG. 7*b* is an alternative to the embodiment in FIG. 7*a.*

An alternate embodiment contemplated would consist of splitting piston 3 into two halves (i.e. an upper 3*a* and lower 3*b* half), each terminating at external ring 42 and with a bearing 100 operatively installed in-between the two halves 3*a* and 3*b*. In this configuration, the bearing 100 separating the two halves of piston 3 would serve to isolate the rotational movement of piston 3*b* to just the half containing the j-slot pattern (i.e. the lower half 3*b*). Consequently, the upper half 3*a* of piston 3 and its corresponding seal 46 would not be subjected to rotational movement which would thereby increase the longevity of seal 46 and the corresponding piston bore within which it is installed. In normal operation of FIG. 7*a*, upper piston 3*a* engages ring 32 of flow tube 6 for tandem axial movement. The j-slot interaction with lower piston 3*b* allows it to rotate as well as translate as it moves in tandem with upper piston 3*a* in axial translation. Bearing 100 allows lower piston 3*b* to rotate relatively to upper piston 3*a* so as to reduce wear on piston seal 46. Snap ring 104 engages surface 106 to pull up the lower piston 3*b* when control line pressure is reduced on top of upper piston 3*a*. FIG. 7*b* works on the same principle except there is a bushing 108 that engages snap ring 104' because bushing 108 is secured to the upper piston 3*a*. In all other respects the operation of FIGS. 7*a* and 7*b* is the same. The result is that the wear on the seal 46 is reduced in that it does not experience rotation while the ability of the lower piston 3*b* to rotate on its long axis while translating allows the needed releasable selective locking in the flapper open and flow tube down position.

Several observations need to be made. The flow tube 6 can be operated by either piston 2 or 3 but the piston 3 has the capability of locking the flapper 10 in the FIG. 4 open position. Pistons 2 and 3 comprise an actuation assembly for the flow tube. In the FIG. 4 open position the lower end 64 of the flow tube 6 is preferably a clearance fit to surface 66 of body 11 shown in FIG. 2. This helps to keep debris away from flapper 10 when in the open position behind the flow tube 6. The use of an indexing mechanism such as a j-slot with relatively large open spaces also reduces the risk of jamming from debris in wellbore fluids. The slots in pattern 48 can have ends that engage pin 50 as shown in FIG. 5 but the preferred embodiment envisions the slots being longer than shown so that motion is stopped extraneous to the pin and slot interaction to avoid shear stress on the pin. A travel stop (not shown) on the piston 3 can be provided to engage the housing 30 on application and removal of pressure at connection 13. Piston 3 is in hydrostatic pressure balance as its underside is connected to the balance line (not shown) connected to connection 40. Piston 2 is configured to be insensitive to tubing pressure whereas piston 3 is not, recognizing that tubing pressure acts upon one side of seal 46 and control line pressure acts upon the other. The safety valve can be held open with piston 3 for normal operation in the position of the pin 50, shown in FIG. 5, being in a portion of the slot pattern 48 such that any loss of pressure or removal of pressure from connection 13 will result in a fail-safe closure of the flapper 10 against seat 38. Connections 12 and 13 can be supplied with a single control line or discrete control lines. With a single control line pressure may need to be cycled one time to get the valve out of the FIG. 4 selectively locked position if normal continuing operation is contemplated. In applications for marine risers using an additional control line for connection 13 in addition to lines going to connections 12 and 40 does not present a space problem. In borehole applications there would need to be room for three lines if a balance line to connection 40 is used.

Alternatively, just two control lines could be used, removing the third line (described as a balance line) connected to connection 40 and reconfiguring piston 2 to be sensitive to tubing pressure. In said configuration, a larger return spring 8 would also be required to overcome the control line hydrostatic pressure applied to the primary piston 2 and the secondary piston 3 at connections 12 and 13.

The design allows redundancy with pistons 2 and 3 for a longer service life and a more reliable operation to avoid downtime for replacement. Another option is to run only piston 3 to have the option of locking open as well as a normal operation with pressure on connection 13 and pin 50, shown in FIG. 5, in the position of slot 68 where loss or removal of pressure results in the flow tube 6 moving up so that the flapper can close.

The above description is illustrative of the preferred embodiment and many modifications may be made by those skilled in the art without departing from the invention whose scope is to be determined from the literal and equivalent scope of the claims below:

We claim:

1. An isolation valve assembly for a tubular string, comprising:

a housing having a passage therethrough and a flapper selectively actuated by a flow tube axially movable in said passage by an actuation assembly located outside said flow tube and at least in part in said housing;

said actuation assembly responsive to a first pressure application and reduction cycle applied to said actuation assembly for said selective locking and further responsive to a second pressure application and reduction cycle applied to said actuation assembly for said allowing said flapper to open and close;

said actuation assembly comprises a piston engaged to said flow tube for tandem movement therewith in a first direction responsive to pressure application in said first pressure application and reduction cycle;

said flow tube and said piston moving in tandem in a second direction opposite said first direction responsive to a return spring acting on said flow tube and a reduction of pressure to said piston to complete said first pressure application and reduction cycle;

said piston comprises a detent selectively rotating to engage said housing at a conclusion of said first pressure application and reduction cycle;

wherein movement of said actuation assembly is regulated by an indexing assembly causing rotation of said actuation assembly as said actuation assembly translates in opposed directions such that said flow tube can be selectively locked to said housing by said actuation assembly with said flapper in an open position, said actuation assembly releasing said flow tube due to rotation, to allow said flapper to thereafter be closed and opened with said actuation assembly.

2. The assembly of claim 1, wherein:

said detent selectively rotating to a disengaged position from said housing at a conclusion of said second pressure application and reduction cycle.

3. The assembly of claim 2, wherein:

said flapper is held open with said pressure application of said second pressure application and reduction cycle and said flapper closes on said reduction of pressure for any reason in said second pressure application and reduction cycle.

4. The assembly of claim 1, wherein:

said piston operably connected to said indexing assembly that further comprises a j-slot pattern interacting with a pin.

5. The assembly of claim 4, wherein:

said housing comprising said pin interacting with ends of slots defining said j-slot pattern during said first and second cycles of pressure application.

6. The assembly of claim 4, wherein:

said pin does not interact with ends of slots defining said j-slot pattern during said first and second cycles of pressure application.

7. The assembly of claim 6, wherein:

said pin is stationary and supported by said housing and said slots of said j-slot pattern are disposed on said piston for translation and rotation relative to said pin.

8. The assembly of claim 6, wherein:

said j-slot pattern has alternating short and long slots such that said flow tube is held against said flapper when said pin is in a said short slot and said flow tube can move away from said flapper when said pin is in a said long slot.

9. The assembly of claim 8, wherein:

said detent engages said housing when said pin is in a said short slot;

said detent is rotated to avoid said housing when said pin is in a said longer slot.

10. The assembly of claim 4, further comprising:

a primary piston connected to said flow tube for tandem movement responsive to pressure application and reduction cycles to a primary piston connection of said housing.

11. The assembly of claim 10, wherein:

said piston communicating to a piston connection in said housing, whereupon application of said first pressure application and reduction cycle to said piston connection moves said flow tube to hold said flapper open and application and reduction of pressure to said primary piston connection moves said flow tube in opposed directions to open and close said flapper.

12. The assembly of claim 11, further comprising:

a return spring to move said flow tube in response to reduction of pressure at said piston connection and at said primary piston connection.

13. The assembly of claim 10, wherein:

said piston and said primary piston are rod pistons.

14. An isolation valve assembly for a tubular string, comprising:

a housing having a passage therethrough and a flapper selectively actuated by a flow tube axially moveable in said passage by an actuation assembly located outside said flow tube and at least in part in said housing;

said actuation assembly releasably locking said flow tube with said flapper in said open position with rotation of at least a part of said actuation assembly;

said actuation assembly comprises an upper piston operably connected to a lower piston for tandem axial movement while enabling said lower piston to relatively rotate with respect to said upper piston; and rotation of said lower piston engages and disengages a detent on said lower piston to said housing.

15. The assembly of claim 14, wherein:

the entirety of said actuation assembly rotates while translating.

16. The assembly of claim 14, wherein:

at least part of said actuation assembly translates without rotation.

17. The assembly of claim 14, wherein:

said lower piston is engaged to an indexing assembly for rotation of said lower piston as said upper and lower pistons move axially in tandem.

18. The assembly of claim 17, wherein:

said upper piston further comprises a seal that experiences no relative rotational movement due to exclusive axial motion of said upper piston.

* * * * *